US005376036A

United States Patent [19]

Hull

[11] Patent Number: 5,376,036

[45] Date of Patent: Dec. 27, 1994

[54] PULL PADDLE FOR SWIM TRAINING

[76] Inventor: Martin P. Hull, 3516 Farm Hill Blvd. - #20, Redwood City, Calif. 94061

[21] Appl. No.: 602,480

[22] Filed: Oct. 24, 1990

[51] Int. Cl.[5] ..... A63B 31/00

[52] U.S. Cl. ..... 441/58

[58] Field of Search ..... 441/55, 56, 57, 58; 272/71, 119

[56] References Cited

U.S. PATENT DOCUMENTS

| | | | |
|---|---|---|---|
| Re. 28,855 | 6/1976 | Montrella | 9/307 |
| 183,045 | 10/1876 | Dunlop | 441/58 |
| 2,556,894 | 6/1951 | Axiotes | 441/56 |
| 3,765,042 | 10/1973 | Montrella | 441/58 |
| 4,756,699 | 7/1988 | Brom | 441/59 |

FOREIGN PATENT DOCUMENTS

| | | | |
|---|---|---|---|
| 30436 | 10/1907 | Austria | 441/58 |
| 834606 | 2/1970 | Canada | 441/58 |

*Primary Examiner*—Stephen P. Avila

*Attorney, Agent, or Firm*—Douglas A. Chaikin

[57] ABSTRACT

Disclosed herein is a pull paddle for swim training which includes a paddle having a leading edge and a trailing edge and a longitudinal centerline extending from the leading edge to the trailing edge. The paddle is tapered so that the leading edge is substantially narrower than the trailing edge. The paddle has a relief in the trailing edge defining a wrist detent. The paddle has a center of force no more than 1½" from the wrist detent along the longitudinal center line and includes structure for selectively gripping the paddle.

1 Claim, 2 Drawing Sheets

PULL PADDLE FOR SWIM TRAINING

CROSS REFERENCE

This application has the same inventorship as Ser. No. 07/292,468, filed Dec. 30, 1988 and now U.S. Pat. No. 4,948,385, Ser. No. Ser. No.: 07/525,372 filed, May 17, 1990 now U.S. Pat. No. 5,108,328 and Ser. No.: 07/428,114, filed Oct. 27, 1989 now U.S. Pat. No. 4,978,119 .

BACKGROUND OF THE INVENTION

1. Field of the Invention

This invention relates to devices to assist a swimmer and more particularly to swimming devices which assist swimmers to train and condition.

A great deal of strength and conditioning is required to swim at a pace that approaches a competitive race (hereinafter "race pace"). Using traditional training methods, it is virtually impossible to maintain this race pace consistently while training and conditioning the swimmer.

A competitive swimmer must coordinate his legs, arms, body rotation and breathing at an extraordinary level to get the maximum forward progress out of each stroke. This extraordinary coordination can only be learned and practiced at speeds approaching race pace because the plane the swimmer makes with the water is different at different speeds. The faster a swimmer's body goes the higher it planes in the water. At race pace, the swimmer's body approaches a parallel plane with the surface of the water. The entry of his arms in the water on the reach portion of a swim stroke is at a very different angle under casual swimming conditions than at race pace. Thus, the necessary sequence of muscular contractions in the muscles of the shoulders and the upper body (hereinafter neuromuscular coordination) that must be developed while going at a race pace is quite different from the neuromuscular coordination that must be developed during ordinary training.

Typically, at race pace, the swimmer goes all out, his muscles strain to their very limits. However, virtually all of the swimmer's training has been at a more casual training pace. Thus, the neuromuscular coordination developed during training is not the same as that which is needed at race pace. The solution would seem to be obvious, train at race pace. However, as pointed out above, this is impossible because the human body can not withstand constant race pace. The swimmer will approach burn out, possibly become injured and become too fatigued to perform at his best during a race.

The problem, then, would seem to be insurmountable; how can one train such that the necessary muscles, body movement and breathing are extraordinarily coordinated at race pace without over taxing the body. Additionally, the problem is how can the swimmer train for maximum coordination while conditioning the body such that the body is at maximum strength and even peaking during a race.

The instant invention, while seemingly quite simple in design, is in fact an extraordinary solution to a very difficult and complex problem.

Another aspect of competition swimming is remaining conditioned while being injured. A substantial portion of the injuries which occur to swimmers, occur to their shoulders. In the past, a swimmer having only slightly injured shoulder could not hope to train at conditions even approaching race pace. The shoulder would have to heal before the swimmer could hope to regain both his conditioning and coordination.

In effect, the swimmer will give up a substantial portion of race season because the injury will be devastating to his coordination. While the swimmer can maintain some conditioning by running or lifting weights or using a kick board or doing other exercises that do not involve his shoulders, he can not maintain the coordination of his shoulders, body rotation, kick and breathing unless he can actually swim and use his shoulder.

Many shoulder injuries are slight enough that some light swimming is possible. However, using past training methods, the risk of re-injury was quite great because of the competitive swimmer's strong desire to get back to competition. Using the device of the instant invention, a swimmer is able to train at speeds approaching race pace without placing undue stress on the injured shoulder, such that it becomes re-injured.

Additionally, precautions must be taken when a swimmer has injured his shoulder because he is even more prone to re-injuring his shoulder and causing even more severe damage. Typically, using past training methods this is precisely what happened to a swimmer. Using the device of the instant invention, a swimmer can return to training at speeds approaching race pace without placing undue stress on the injured shoulder and risking repeated and greater injury.

Implicit in the instant invention is the recognition that a swimmer puts far less stress on his shoulders during the arm reach when he is planning at a higher level on the water, i.e. when the swimmer is at race pace. The swimmer's arm reaches toward the water at an angle which is far more comfortable, more efficient and less stressful to the shoulders than the arm entry position of the more common training pace. Thus, the instant invention allows the swimmer to continue training at speeds approaching race pace with a minimum risk of re-injuring the injured shoulder.

Swimming is one of the most popular and healthiest forms of recreation available. Many persons learn to swim without proper instruction. As is well known, old habits are difficult to break. Thus, there is an important need to find a device that assists the novice and even the advanced swimmer in developing and continuing the proper swimming technique.

Typical pull paddles such as Montrella, Re. 28,855 include a rigid sheet material in a substantially rectangular configuration, having an aft edge with a relief for the wrist of a user and additionally having a wrist band and a center finger band.

Typically such paddles cause an artificial reduction in the amount of force that the arm can be applied to the hand and forearm. This is so because the forearm is typically not strong enough to maintain the initial angle of the stroke, thereby decreasing the amount of force that is exerted by the forearm.

In order to further and more fully appreciate the skill in the art, it is necessary to describe the following terms:

Definition of the Center of Force: the point on the surface of a pull paddle which when a force is applied to move the pull paddle through a body of water will cause no rotational force to be applied to the pull paddle.

Definition of the Lever Arm: the distance between the center of force and the apex of the wrist detent.

The muscles of the forearm can easily become overloaded. If this overload occurs, the swimmer intuitively and frequently unconsciously decreases the amount of force being transmitted to the arm by the major propulsive muscles of the torso, shoulder and upper arm. This decrease in force allows the overloaded forearm muscles to continue to maintain the correct angle of attack of the hand. The result is that the swimmer does not stress the major propulsive muscles of the upper body to maximum potential. If these muscles are not exercised to their maximum potential, the swimmer will not develop the strength and conditioning that is desired.

The forearm overload condition can occur when additional stress to the forearm is encountered from existing pull paddles which have a center of force too far from the wrist joint. The farther the center of force is from the wrist joint, the longer the lever arm is which acts against the forearm muscles. The longer the lever arm, the more stress that is transmitted to the forearm muscles.

Applicant has discovered that by moving the center of force closer to the wrist joint, the lever arm is decreased which allows the forearm not to artificially limit the force exerted by the entire arm on the pull paddle. Additionally, by moving the center of force closer to the wrist joint, the stress to the forearms is decreased discouraging overload until greater forearm stress levels are reached. Additionally, it has now been discovered that by having a tapered pull paddle (wherein the front is narrower than the rear instead of a rectangular pull paddle the center of force can be moved closer to the wrist, thereby decreasing the lever arm.

SUMMARY OF THE INVENTION

It is an object of this invention to provide a pull paddle for training which is suitable for assisting a swimmer.

It is a further object of this invention to provide a pull paddle for training which assists the user in achieving race pace coordination of arms and legs.

It is a further object of this invention to provide a pull paddle which benefits cardiovascular and arm and leg conditioning.

It is a further object of this invention to provide a pull paddle which encourages correct swimming technique.

In accordance with the above objects and those that will be mentioned and will become apparent below, the pull paddle in accordance with this invention, comprises:

a paddle having a leading edge and a trailing edge and a longitudinal centerline extending from the leading edge to the trailing edge, the paddle being tapered so that the leading edge is substantially narrower than the trailing edge;

the paddle having a relief in the trailing edge defining a wrist detent;

the paddle having a center of force no more than 1½" from the wrist detent along the longitudinal center line: and grip means for selectively gripping the paddle.

The pull paddle in accordance with this invention allows the user to have a high speed stroke rate with better propulsive force and which activates more muscle mass during the arm stroke. Thus, the swimmer not only goes faster, but also does so with greater efficiency and is able to do so for a longer period of time without risk of shoulder injury since unlike typical pull paddles (which have a substantially longer lever arm), the entire arm is not able to overpower the forearm muscles.

In a preferred embodiment, the center of force is 1" from the wrist detent and the paddle is symmetrical about a longitudinal centerline.

It is an advantage of this invention to enable a user to train more muscle mass with a minimum of risk to the swimmer.

It is an additional advantage of this invention to enable a user to continue training even during recovery from a shoulder injury.

It is an additional advantage of this invention to enable a user to duplicate race pace conditions without causing the stress and without requiring the stamina of a race.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
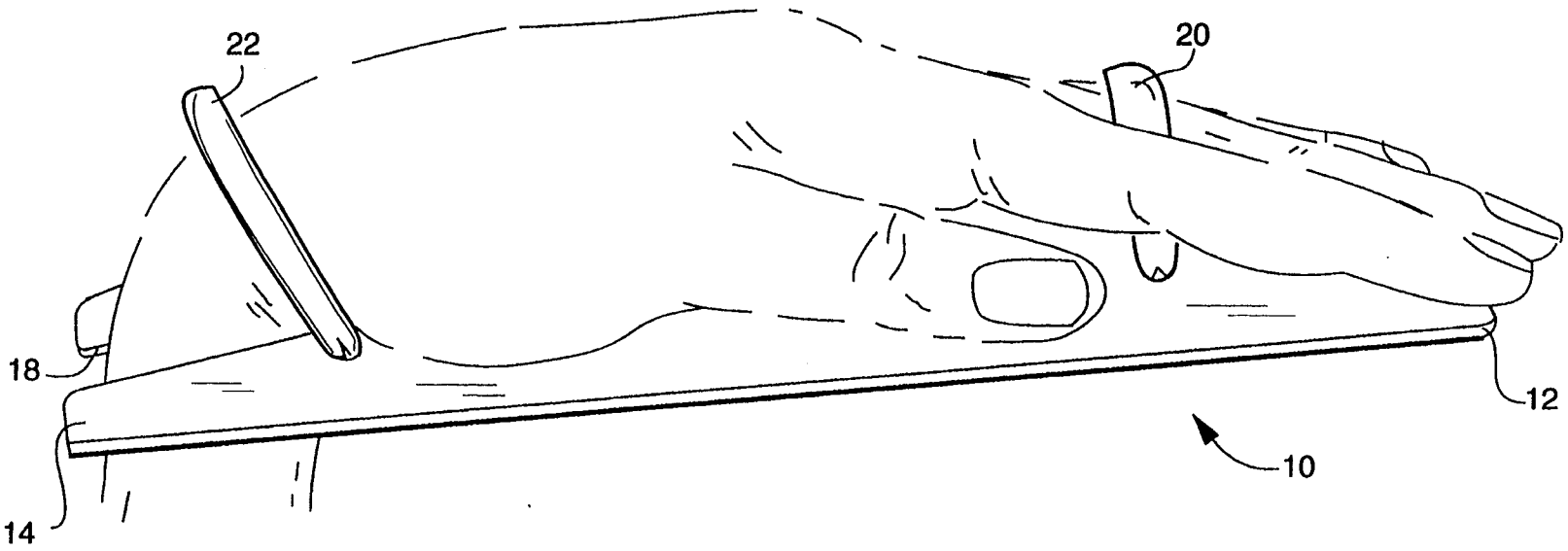
FIG. 1 is a side perspective view of a pull paddle in accordance with this invention in use.

The invention will be described below with reference the above FIGS. 1–4. With particular reference FIG. 1, there is shown a pull paddle in accordance with this invention, generally denoted by take numeral 10. The pull paddle 10 has a leading edge 12 and a trailing edge 14. As can be seen more clearly with reference to FIGS. 2 & 3, a longitudinal center line 16 extends from the leading edge 12 to the trailing edge 14.

Figure 2:
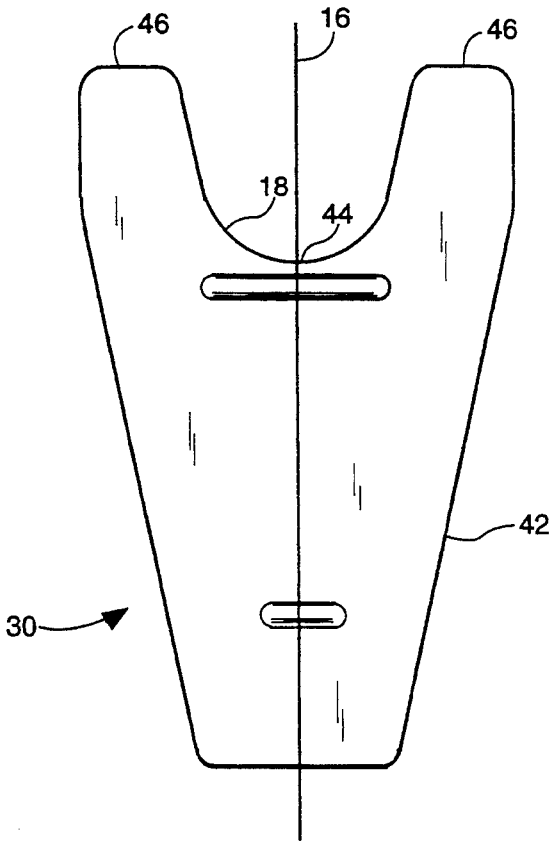
FIG. 2 is a top plan view of one embodiment of a pull paddle in accordance with this invention.
Figure 3:
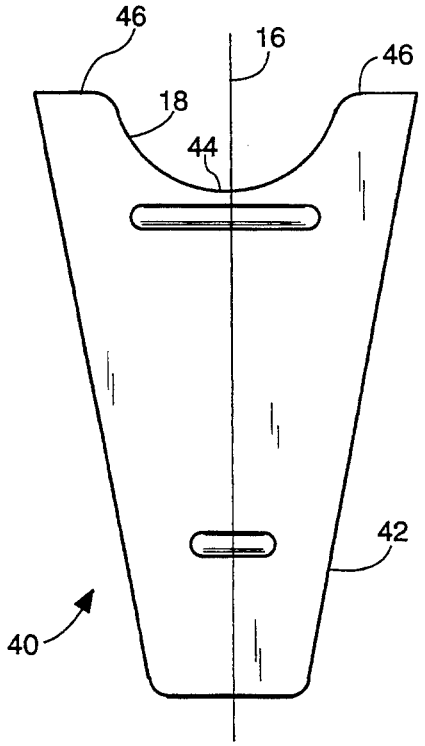
FIG. 3 is a top plan view of alternate embodiment of a pull paddle in accordance with this invention.

As can be seen clearly from FIGS. 2 and 3, the pull paddle 10 is symmetrical about the longitudinal center line 16. Additionally, the pull paddle 10 is tapered so that the leading edge 12 is substantially narrower than the trailing edge 14. In the preferred embodiments described with respect to FIGS. 2–4, the leading edge 12 is approximately one-half as wide as the trailing edge 14.

The trailing edge 12 has a relief defining a wrist detent 18. The wrist detent 18 is semi-circular and symmetrical about the longitudinal center line 16. The wrist detent 18 allows the wrist of the user to fit compatibly with the pull paddle 10 without unnecessary rubbing against the wrist.

As described above, the center of force determines the efficiency of a swimmer's efforts. It has been discovered that when the center of force is fairly closely spaced to the wrist, the swimmer's efforts at moving through the water with the pull paddle 10 are maximized.

As defined above, the lever arm determines the leverage a user achieves from the exertion of his muscles on the paddle. If the lever arm is too large, then the forearm muscles are overpowered by the entire arm. If the lever arm is too short, then insufficient stress will be placed upon the forearm for conditioning. In a preferred embodiment, the lever arm is less than 1½" (wherein the center of force is less than 1½" from the wrist detent 18 along the longitudinal center line 16).

The pull paddle 10 additionally includes two grips 20 and 22 for securing the hand of a user to the paddle. The grip 20 is proximal to the leading edge 12 and is designed to grip the finger of the user; while the grip 22 is proximal the wrist detent 18 and is designed to grip the wrist of the user to the pull paddle 10.

Each of the grips 20 and 22 is adjustable. The grips 20 and 22 comprise surgical tubing. The grips 20 and 22 are attached to the pull paddle 10 through openings (not shown) as is conventional with such devices. In order to tighten the grips 20 and 22, the surgical tubing is simply pulled through the openings. In order to loosen the grips 20 and 22, the surgical tubing is simply pushed through the openings. In the preferred embodiments shown in FIGS. 2–4, the grip 20 is 3½" long, while the grip 22 is 7½" long.

Figure 4:
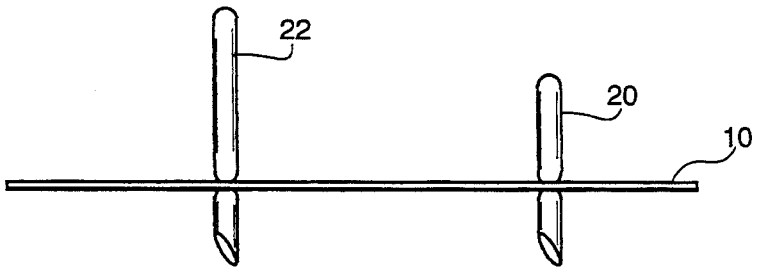
FIG. 4 is a side view of the pull paddle embodiment shown in FIG. 3.

With respect to FIGS. 2–4, there are shown two preferred embodiments of a pull paddle in accordance with this invention, generally denoted by the numerals 30 and 40. Each of the pull paddles 30 and 40 is made from a flexible material such as polyethylene, approximately ⅛" thick. Each of the pull paddles 30 and 40 have outside edges 42 which have a constant taper from the leading edge 12 to the trailing edge 14. Additionally, each wrist detent 18 is semi-circular having an apex 44 intersecting the longitudinal center line 16 of the respective pull paddles 30 and 40.

With particular reference to FIG. 2, there is shown the larger of the pull paddles 30 and 40. The pull paddle 30 has length from the leading edge 12 to trailing edge 14 of approximately 10¾". The width of the trailing edge 12 of the pull paddle 30 is approximately 8⅜", while the width of the trailing edge 14 is approximately 6⅞". It will be appreciate that the ratio of the leading edge 12 to the trailing edge 14 is 1:2.

The combination of the wrist detent 18 and the trailing edge 14 produces a pair of tail sections 46 in each of the pull paddles 30 and 40. The tail sections 46 of the pull paddle 30 is approximately 1" wide and 3¼" long.

With particular reference to FIGS. 3 & 4, the smaller pull paddle 40 will now be described. The pull paddle 40 has length from the leading edge 12 to trailing edge 14 of approximately 5 ⅛". The leading edge 12 of the pull paddle 40 is 2⅞" wide, while the trailing edge 14 is 5¾" wide. Again, as with the larger embodiment of the pull paddle 30, the ratio of the leading edge 12 to the trailing edge 14 is 1:2.

The center of force of the pull paddles 30 and 40 are determined by the degree of taper of the pull paddles 30 and 40. As described above, it has been found by experimentation that when the leading edge 12 is approximately one-half of the trailing edge 14 the center of force is approximately 1" from the wrist detent 18 in order to maximize the user's efforts, the grips 20 and 22 are positioned so the moment of force that the user exerts on the paddle coincides with the paddle's center of force which is the maximum amount of stress which can be exerted without forearm overload.

Each of the pull paddles 30 and 40 have their respective center of force approximately 1" from the apex. Thus, the corresponding size of the lever arm of the pull paddles 30 and 40 is also approximately 1".

While the foregoing detailed description has described several embodiments of the pull paddle in accordance with this invention, it is to be understood that the above description is illustrative only and not limiting of the disclosed invention. Particularly, the pull paddle in accordance with this invention may be made of a variety of materials and in a variety of shapes. It will be appreciated that all of these shapes and materials are within the scope and spirit of this invention. Thus the invention is to be limited only by the claims as set forth below.

What is claimed is:

1. A swim training pull paddle, comprising a paddle having a leading edge and a trailing edge and a longitudinal center line extending from the leading edge to the trailing edge, the paddle having outside edges extending from the leading edge to the trailing edge and each of the outside edges having a constant taper with respect to the longitudinal center line from the leading edge to the trailing edge, the paddle being tapered so that the leading edge is substantially narrower than the trailing edge;

the paddle having a relief in the trailing edge defining a wrist detente;

the paddle having a center of force no more than 11/2" from the wrist detente along the longitudinal center line, and a paddle having an overall length of at least measured from one edge to the other;

grip means for selectively gripping the paddle;

wherein the user has a high speed stroke rate with better propulsive force and more muscle mass is activated during the arm stroke with a minimum of risk of injury to the use.

* * * * *